US005970894A

United States Patent [19]

Mase

[11] Patent Number: 5,970,894

[45] Date of Patent: Oct. 26, 1999

[54] SEWING APPARATUS AND PROGRAM STORAGE MEDIUM

[75] Inventor: Yasufumi Mase, Nagoya, Japan

[73] Assignee: Brother Kyogo Kabushiki Kaisha, Nagoya, Japan

[21] Appl. No.: 09/163,354

[22] Filed: Sep. 30, 1998

[30] Foreign Application Priority Data

Sep. 30, 1997 [JP] Japan ..... 9-267423

[51] Int. Cl.[6] ..... D05C 5/06; D05C 9/06; D05B 21/00

[52] U.S. Cl. ..... 112/102.5; 112/470.04; 364/470.09

[58] Field of Search ..... 112/102.5, 470.06, 112/470.04, 445; 364/470.07, 470.09; 702/185, 188

[56] References Cited

U.S. PATENT DOCUMENTS 4,479,446 10/1984 Johnson et al. ..... 112/102.5
5,365,867 11/1994 Hatch et al. ..... 112/104 X
5,555,505 9/1996 Oosawa et al. ..... 364/470.07
5,583,801 12/1996 Croyle et al. ..... 702/185
5,831,858 11/1998 Wakayama ..... 112/102.5 X
5,881,657 3/1999 Asano ..... 112/102.5

*Primary Examiner*—Peter Nerbun
*Attorney, Agent, or Firm*—Oliff & Berridge, PLC

[57] ABSTRACT

A sewing apparatus is provided with (a) a sewing machine provided with: an identification information storing device for storing machine identification information, which is individually set in advance for the sewing machine; an identification information outputting device for outputting the machine identification information stored in the identification information storing device: and a sewing device for sewing a pattern, and (b) a management apparatus connectable to the sewing machine, for managing the sewing machine based on the machine identification information received from the identification information outputting device when the sewing machine is connected to the management apparatus.

24 Claims, 14 Drawing Sheets

SEWING APPARATUS AND PROGRAM STORAGE MEDIUM

BACKGROUND OF THE INVENTION

1. Field of the Invention

The present invention relates to a sewing apparatus including a sewing machine, which is provided with a CPU (Central Processing Unit) and which can electronically perform information processing, such as a selection of a pattern to be sewed, and automatically perform a sewing process. The present invention also relates to a program storage medium for storing a program of instructions executable by a computer in the sewing apparatus.

2. Description of the Related Art

There is a sewing apparatus including a so-called embroidery sewing machine, which is provided with a built-in microcomputer containing a CPU or which is connected with an external computer so as to control the sewing machine by using the external computer, so that the sewing machine can perform various processes, such as an automatic sewing operation of a desired embroidery, for example, just by selecting a pattern to be embroidered by the use of a touch panel etc., on the sewing machine or by selecting it on the external computer.

However, in the above mentioned sewing apparatus including the embroidery sewing machine, identification information, such as a serial number which is given when the embroidery sewing machine is produced in order to identify the embroidery sewing machine one by one, is not stored or memorized in the embroidery sewing machine. Thus, the sewing apparatus has such a problem that it cannot perform a systematic effective management of the embroidery sewing machine. For example, it cannot accumulate the information as for what kind of repair has, been previously performed, which part has been replaced or the like on a certain embroidery sewing machine, so that a new repair cannot be carried out with reference to the accumulated information, by identifying or distinguishing each embroidery sewing machine.

On the other hand, in case that a pattern which can be embroidered by the embroidery sewing machine is determined in advance on the basis of a grade (type) of the embroidery sewing machine assigned by a distributor, that is, in case that there is a pattern which a low grade type embroidery sewing machine is not allowed to embroider but which a high grade type (e.g., expensive type) embroidery sewing machine is allowed to embroider, since the management cannot be performed for each embroidery sewing machine after the sale, the pattern data corresponding to the pattern which can be embroidered only by the high grade type embroidery sewing machine may be sent or distributed with respect to the low grade type embroidery sewing machine. This results in a problem that the distributor side and the like may sustain unexpected damage.

SUMMARY OF THE INVENTION

The present invention is proposed in view of the above mentioned problems. It is therefore an object of the present invention to provide a sewing apparatus including an embroidery sewing machine or machines which can systematically manage each embroidery sewing machine, and a program storage medium which can systematically manage a sewing apparatus including a sewing machine or machines.

The above object of the present invention can be achieved by a first sewing apparatus provided with (a) a sewing machine such as an embroidery sewing machine provided with: an identification information storing device such as an EEPROM for storing machine identification information, which is individually set in advance for the sewing machine; an identification information outputting device such as a communication connector for outputting the machine identification information stored in the identification information storing device; and a sewing device for sewing a pattern, and (b) a management apparatus such as a pattern data editing apparatus connectable to the sewing machine, for managing the sewing machine based on the machine identification information received from the identification information outputting device when the sewing machine is connected to the management apparatus.

According to the first sewing apparatus, the machine identification information, which is individually set in advance for the sewing machine, is stored in the identification information storing device. When the sewing machine is connected to the management apparatus, the machine identification information stored in the identification information storing device is outputted by the identification information outputting device. Then, based on this outputted and received machine identification information, the sewing machine is managed by the management apparatus by using this outputted and received machine identification information. Accordingly, since the sewing machine is managed by the management apparatus by using the machine identification information, it is possible to efficiently and systematically manage the sewing machine in the sewing apparatus.

In one aspect of the first sewing apparatus, the management apparatus is provided with: a repair history storing device such as a data base for storing repair history information indicating a repair history recorded for the sewing machine when the sewing machine is repaired; and an updating device such as a host computer for updating the repair history information corresponding to the sewing machine which has been repaired based on the machine identification information corresponding to the sewing machine which has been repaired, in the repair history storing device.

According to this aspect, when the sewing machine is repaired, the repair history information indicating the repair history recorded for the sewing machine is stored into the repair history storing device. Then, based on the machine identification information corresponding to the repaired sewing machine, the repair history information corresponding to the repaired sewing machine in the repair history storing device is updated by the updating device. Accordingly, since the repair history information is updated and managed based on the machine identification information, the repair can be carried out efficiently with reference to the repair history in the past upon repairing the sewing machine.

In another aspect of the first sewing apparatus, the management apparatus is provided with: a pattern data storing device such as a CD-ROM for storing various kinds of pattern data indicating various kinds of patterns set in advance for a sewing process performed by the sewing machine; and a data outputting device such as a pattern information output unit for outputting only pattern data corresponding to the machine identification information received from the identification information outputting device when the sewing machine is connected to the management apparatus, from among the various kinds of pattern data stored in the pattern data storing device, as pattern data particular to the sewing machine. The sewing device performs the sewing process based on the particular pattern data outputted by the data outputting device.

According to this aspect, various kinds of pattern data indicating various kinds of patterns set in advance for the sewing process is stored in the pattern data storing device. When the sewing machine is connected to the management apparatus, only pattern data corresponding to the outputted machine identification information from among the various kinds of pattern data stored in the pattern data storing device is output ted as the particular pattern data to the sewing machine by the data outputting device. Then, the pattern corresponding to the outputted particular pattern data is sewn by the sewing device. Accordingly, since only the particular pattern data corresponding to the machine identification information is supplied to the sewing machine, it is possible to prevent the pattern data other than the particular pattern data corresponding to the machine identification information from being carelessly supplied to the sewing machine.

In this aspect of having the pattern data storing device, the machine identification information may include specification information to specify the particular pattern data indicating the pattern sewable by the sewing machine. The data outputting device may output only pattern data specified by the specification information, which is included in the machine identification information received from the identification information outputting device, from among the various kinds of pattern data stored in the pattern data storing device, as the particular pattern data to the sewing machine.

Thus, only pattern data specified by the specification information indicating the pattern sewable by the sewing machine from among the various kinds of pattern data stored in the pattern data storing device is outputted as the particular pattern data to the sewing machine by the data outputting device. Accordingly, since only the pattern data indicating the pattern sewable by the sewing machine is supplied to the sewing machine by means of the specification information, it is possible to prevent the pattern data indicating the pattern which is not sewable or is not to be used in the sewing machine from being supplied to the sewing machine.

In this case, the specification information may include information indicating at least one of a maker and a grade of the sewing machine. Thus, at least one of the maker and the grade of the sewing machine can be referred to by the management apparatus as the occasion demands.

Further in this case, the pattern data storing device may store the various kinds of pattern data in correlation with information indicating at least one of a maker and a grade, and the data outputting device may output the pattern data by matching the information indicating at least one of the maker and the grade included in the specification information and that stored in the pattern data storing device. Thus, it is possible to supply the pattern data appropriate for at least one of the maker and the grade of the sewing machine to the sewing machine.

In this aspect of having the pattern data storing device also, the management apparatus may be further provided with a personal information inputting device for inputting personal identification information to identify a user who uses the sewing machine to perform the sewing process based on the particular pattern data. The data outputting device may output only pattern data corresponding to the inputted personal identification information and the received machine identification information, as the pattern data particular to the sewing machine.

Thus, the personal identification information to identify the user is inputted by the personal information inputting device. Then, only pattern data corresponding to the inputted personal identification information and the received machine identification information is outputted as the particular pattern data, to the sewing machine by the data outputting device. Accordingly, it is possible to prevent a user who is not allowed to use the particular pattern data from using the particular pattern data.

In another aspect of the first sewing apparatus of the present invention, the sewing machine and the management apparatus are connected to each other by a serial cable.

In another aspect of the first sewing apparatus of the present invention, the sewing machine and the management apparatus are connected to each other by an external rewritable ROM card.

In another aspect of the first sewing apparatus of the present invention, the sewing machine and the management apparatus are connected to each other by an infrared ray.

In another aspect of the first sewing apparatus of the present invention, the sewing machine and the management apparatus are connected to each other by a local area network cable.

The above object of the present invention can be also achieved by a program storage medium readable by a computer in a sewing apparatus provided with a sewing machine and a management apparatus which is connectable to the sewing machine, tangibly embodying a program of instructions executable by the computer to perform method processes for managing the sewing machine by the management apparatus. The method processes include: an identification information storing process of storing machine identification information, which is individually set in advance for the sewing machine, into an identification information storing device in the sewing machine; an identification information outputting process of outputting the machine identification information stored in the identification information storing device from an identification information outputting device in the sewing machine; a sewing process of sewing a pattern in the sewing machine; and a managing process of managing the sewing machine based on the machine identification information received from the identification information outputting device when the sewing machine is connected to the management apparatus.

According to the program storage medium such as a CD-ROM, a floppy disk or a ROM, when the program stored in the third program storage medium is installed to and executed by the computer in the management apparatus, the management apparatus functions in the same manner as the management apparatus of the above described first sewing apparatus of the present invention. Thus, since the sewing machine is managed by the management apparatus by using the machine identification information, it is possible to efficiently and systematically manage the sewing machine in the sewing apparatus.

In one aspect of the program storage medium, the managing process includes: a repair history storing process of storing repair history information indicating a repair history recorded for the sewing machine into a repair history storing device in the management apparatus when the sewing machine is repaired; and an updating process of updating the repair history information corresponding to the sewing machine which has been repaired based on the machine identification information corresponding to the sewing machine which has been repaired, in the repair history storing device.

According to this aspect, by executing the program stored in the program storage medium, the repair history information is updated and managed in accordance with the identification information. Thus, when the sewing machine is repaired, it is possible to refer to the previous repair history to thereby carry out the effectively repairing operation.

In another aspect of the program storage medium of the present invention, the managing process includes: a pattern data storing process of storing various kinds of pattern data indicating various kinds of patterns set in advance for the sewing process performed by the sewing machine, into a pattern data storing device in the management apparatus; and a data outputting process of outputting only pattern data corresponding to the machine identification information received from the identification information outputting device when the sewing machine is connected to the management apparatus, from among the various kinds of pattern data stored in the pattern data storing device, as pattern data particular to the sewing machine. And that, in the sewing process, the pattern is sewn by the sewing machine based on the particular pattern data outputted by the data outputting process.

Thus, when the program stored in the program storage medium is installed to and executed by the computer in the management apparatus, since only the particular pattern data corresponding to the machine identification information is supplied to the sewing machine, it is possible to prevent the pattern data other than the particular pattern data corresponding to the machine identification information from being carelessly supplied to the sewing machine.

In this aspect of having the pattern data storing process, the machine identification information may include specification information to specify the particular pattern data indicating a pattern sewable by the sewing machine. And that, in the data outputting process, only pattern data specified by the specification information, which is included in the machine identification information received from the identification information outputting device, is outputted from among the various kinds of pattern data stored in the pattern data storing device, as the particular pattern data sewable by the sewing machine.

Thus, by executing the program stored in the program storage medium, since only the pattern data indicating the pattern sewable by the sewing machine is supplied to the sewing machine by means of the specification information, it is possible to prevent the pattern data indicating the pattern which is not sewable or is not to be used in the sewing machine from being supplied to the sewing machine.

In this case, the specification information may include information indicating at least one of a maker and a grade of the sewing machine. Thus, at least one of the maker and the grade of the sewing machine can be referred to by the management apparatus as the occasion demands.

Further in this case, in the pattern data storing process, the various kinds of pattern data may be stored in correlation with information indicating at least one of a maker and a grade of the sewing machine, and in the data outputting process, the pattern data may be outputted by matching the information indicating at least one of the maker and the grade included in the specification information and that stored in the pattern data storing process. Thus, it is possible to supply the pattern data appropriate for at least one of the maker and the grade of the sewing machine to the sewing machine.

In another aspect of the program storage medium, the method processes further include a personal information inputting process of inputting personal identification information to identify a user who uses the sewing machine to perform the sewing process based on the particular pattern data. And that, in the data outputting process, only pattern data corresponding to the inputted personal identification information and the received machine identification information is outputted as the pattern data particular to the sewing machine.

According to this aspect, by executing the program stored in the program storage medium, it is possible to prevent a user who is not allowed to use the particular pattern data from using the particular pattern data.

The nature, utility, and further features of this invention will be more clearly apparent from the following detailed description with respect to preferred embodiments of the invention when read in conjunction with the accompanying drawings briefly described below.

DETAILED DESCRIPTION OF THE PREFERRED EMBODIMENTS

Preferred embodiments of the present invention will be explained below with reference to the drawings.

(I) First Embodiment

A first embodiment of the present invention will be explained with reference to FIG. 1 to FIG. 8.

In the embodiment explained below, the present invention is applied to a sewing apparatus including; an embroidery sewing machine equipped with an LCD (Liquid Crystal Display) device etc., in a main body thereof; and a pattern data editing apparatus as one example of a managing apparatus constructed by a computer etc., for supplying pattern data, which corresponds to a pattern to be sewed, to the embroidery sewing machine.

At first, an appearance of an embroidery sewing machine of the embodiment is explained with reference to FIG. 1.

Figure 1:
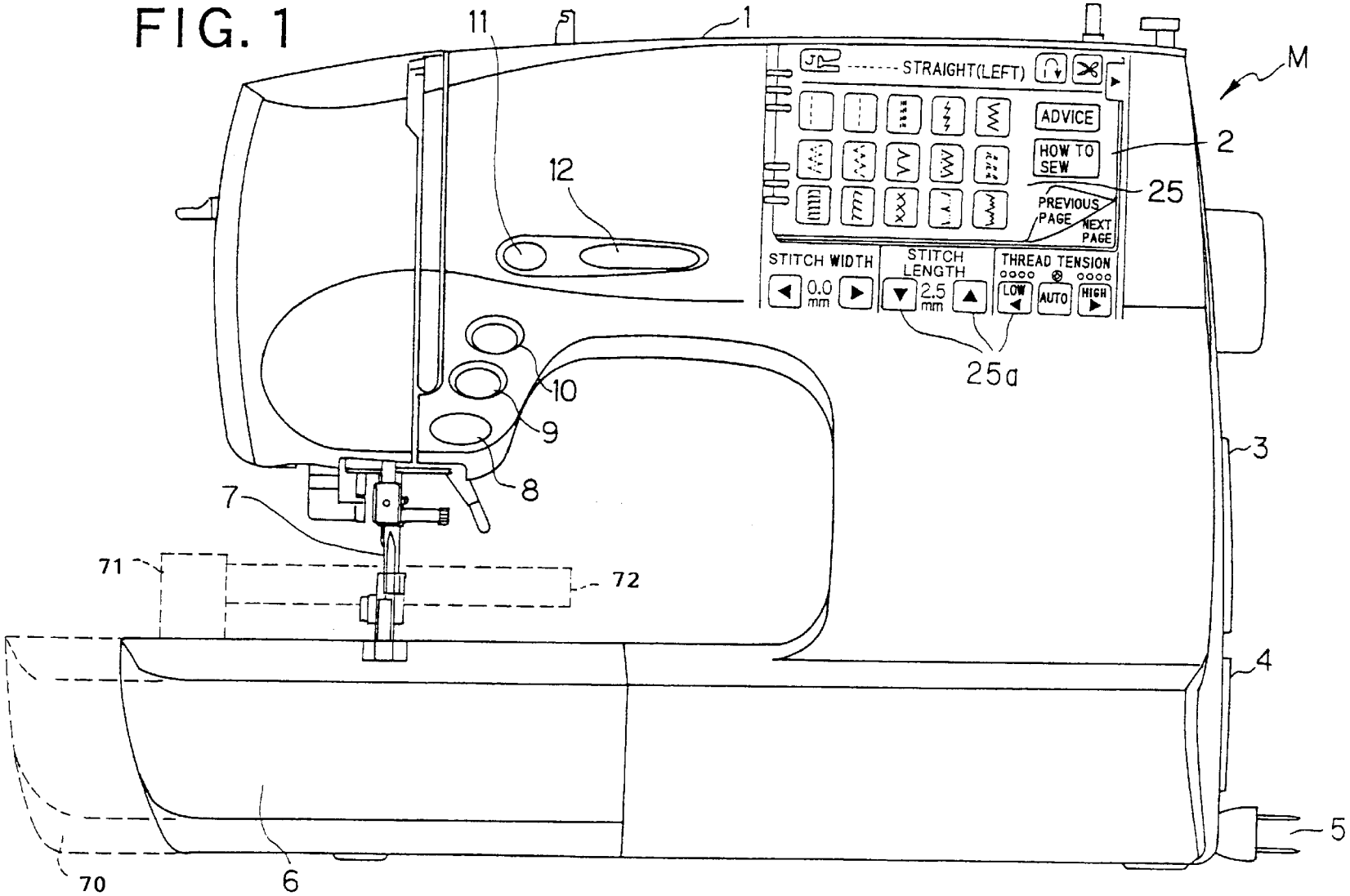
FIG. 1 is a side view showing a schematic configuration of an embroidery sewing machine of an embodiment of the present invention.

In FIG. 1, an embroidery sewing machine M is provided, on a main body 1, with: an LCD panel 2 as one example of a displaying device for displaying an operation status etc., of the embroidery sewing machine M during sewing various embroideries; a card connector 3 as a portion of one example of an outputting device, to which an external ROM (Read Only Memory) card etc., for storing pattern data corresponding to the pattern edited by the above mentioned pattern data editing apparatus etc., and for storing identification information described later is to be connected; a communication connector 4 as another portion of one example of the outputting device for performing transmission and reception of data including the identification information described later etc., by connecting an external computer such as the pattern data editing apparatus etc., with the embroidery sewing machine M; an electric source cable 5; a cloth fixing platform 6 on which a cloth is fixed during sewing; a sewing needle 7 as one example of a stitch forming device for actually sewing; a start/stop button 8 operated when the sewing operation is to be started and stopped; a backstitch button 9 operated when a backstitch is performed; a needle up and down button 10 operated when the sewing needle 7 is manually moved up and down; a thread cutting button 11 operated when a thread is cut after sewing etc. and a motor speed control 12 for adjusting a rotation speed of a motor to move up and down the sewing needle 7.

Incidentally, on a surface of the LCD panel 2, a touch panel 25 is disposed which includes one or more keys 25*a* to perform various inputting operations.

Further, in the cloth fixing platform 6, a rotating motor for moving the cloth fixed on the cloth fixing platform 6 within a X-Y plane perpendicular to the moving direction of the sewing needle 7 in correspondence with the pattern to be embroidered etc., a loop taker for storing a bobbin thread and so on are accommodated.

When actually sewing a sewing pattern, in addition to the constitutional elements of the embroidery sewing machine M as indicated by a solid line in FIG. 1, the embroidery sewing machine M is provided, as indicated by a dashed line in FIG. 1, with: an embroidery frame 72 for fixing a cloth to which a sewing pattern is to be embroidered; a moving body 71 for moving the embroidery frame 72 in a direction perpendicular to the paper surface of FIG. 1 in correspondence with the sewing pattern to be sewn; and an embroidering device 70 for moving the embroidery frame 72 in a direction parallel to the paper surface of FIG. 1 by moving the moving body 71 in a direction parallel to the paper surface of FIG. 1 in correspondence with the sewing pattern to be sewn. Within the embroidery device 70, an X direction driving motor 23 and a Y direction driving motor 24, which will be described later, for moving the embroidery frame 72 within a plane perpendicular to the moving direction of the sewing needle 7 by driving the moving body 71 and moving the moving body 71 in a direction perpendicular to the paper surface of FIG. 1.

Next, the internal structure of the embroidery sewing machine M is explained with reference to a block diagram shown in FIG. 2.

The operation of the embroidery sewing machine M is concentrically controlled by a signal processing unit 15 within the embroidery sewing machine M.

Figure 2:
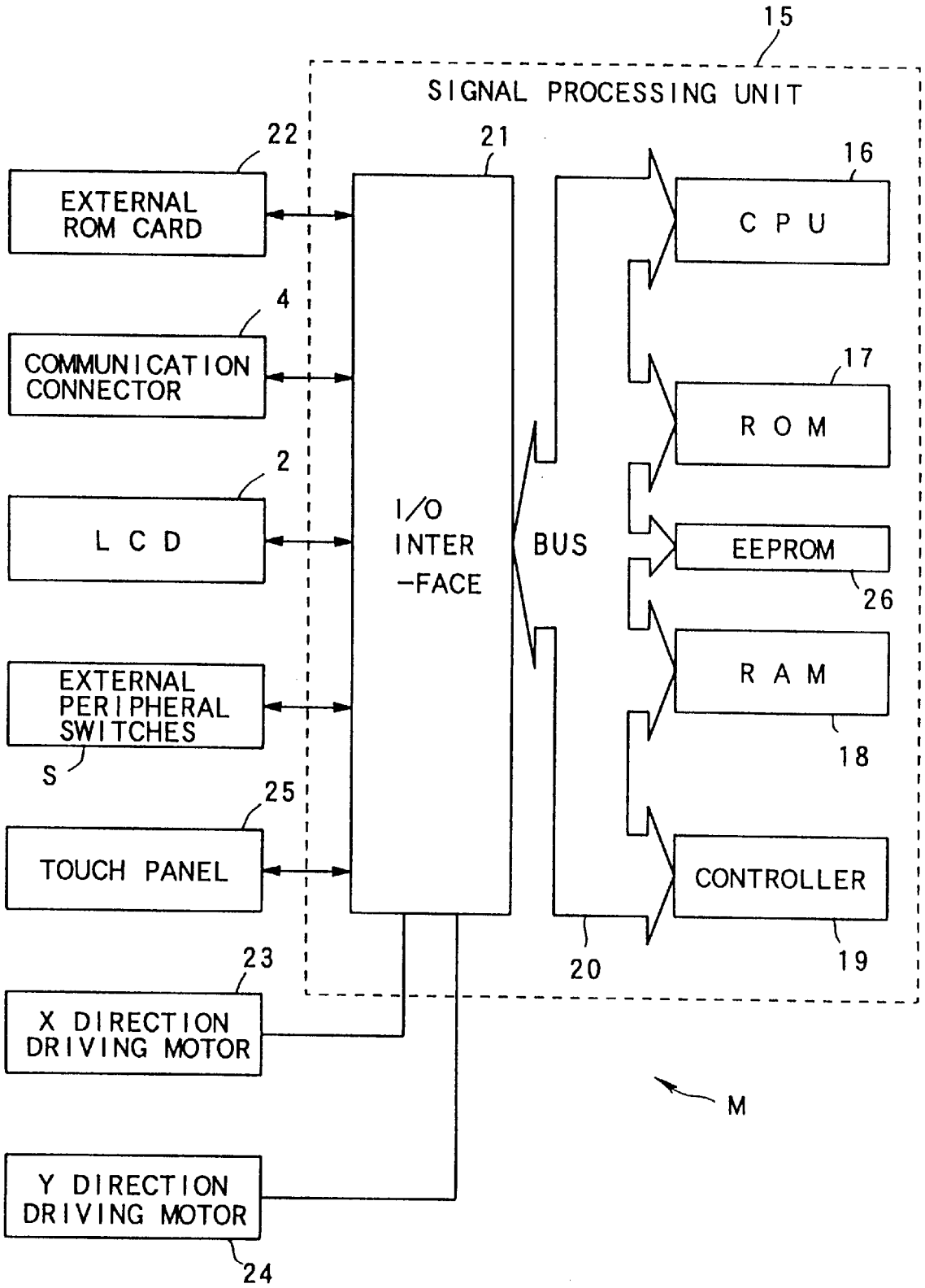
FIG. 2 is a block diagram showing an inner schematic configuration of the embroidery sewing machine.

In FIG. 2, the signal processing unit 15 is provided with: a CPU 16 for actually performing a control of the embroidery sewing machine M: a ROM 17 for storing a control program for operating the CPU 16 etc., in advance in a readable manner; a RAM (Random Access Memory) 18 for temporarily storing data necessary for controlling the embroidery sewing machine M etc., in a readable manner; a communication bus 20 for connecting each constitutional element within the signal processing unit 15; a controller 19 for controlling the connections between the constitutional elements respectively by the communication bus 20 and an input/output (I/O) interface 21; the input/output interface 21 for connecting the signal processing unit 15 with external constitutional elements; and an EEPROM (Electrically Erasable/Programmable ROM) 26 as one example of a memory and also one example of an identification information storage device for storing peculiar information such as identification information or the like which will be described later. The EEPROM 26 is adapted to electrically re-write the storage content and to maintain the storage content even after the electric source for the embroidery sewing machine M itself is turned off.

Then, the signal processing unit 15 is connected through the input/output interface 21 with: an external ROM card 22 which is inserted into the card connector 3 (refer to FIG. 1); the communication connector 4; the LCD panel 2; external peripheral switches S (i.e., which is a generic name of the start/stop button 8, the backstitch button 9, the needle up and down button 10 etc., shown in FIG. 1 which are the buttons for operating the embroidery sewing machine M from the external); the touch panel 25; the X direction driving motor 23; the Y direction driving motor 24; and so on.

Incidentally, the operation of the embroidery sewing machine M of the present embodiment is performed under the control of the CPU 16. The program corresponding to the processing operation indicated by each flow chart, which will be described later, and necessary for the control of the CPU 16 is stored in the ROM 17 in advance.

The identification information according to the present invention stored in the EEPROM 26 is explained below with reference to FIG. 3.

Figure 3:
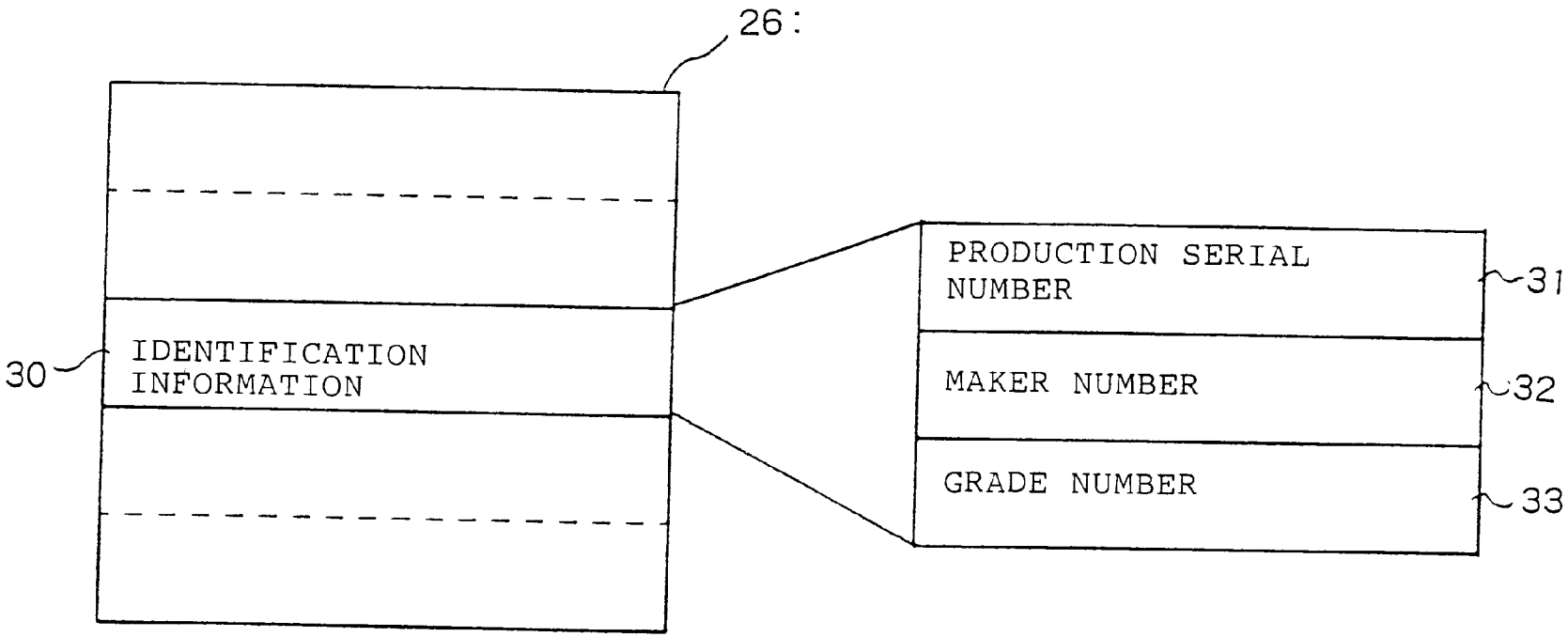
FIG. 3 is a diagram showing a configuration of identification information stored in the embroidery sewing machine.

As shown in FIG. 3, identification information 30 stored in the EEEPROM 26 actually includes: a production serial number 31 which is separately given to each embroidery sewing machine M when it is produced; a maker number 32 which is a name of a maker of the embroidery sewing machine M; and a grade number 33 showing a grade or rank to which the embroidery sewing machine M belongs. The grade or rank is determined in advance on the basis of a price, a function or the like of the embroidery sewing machined M.

Figure 4:
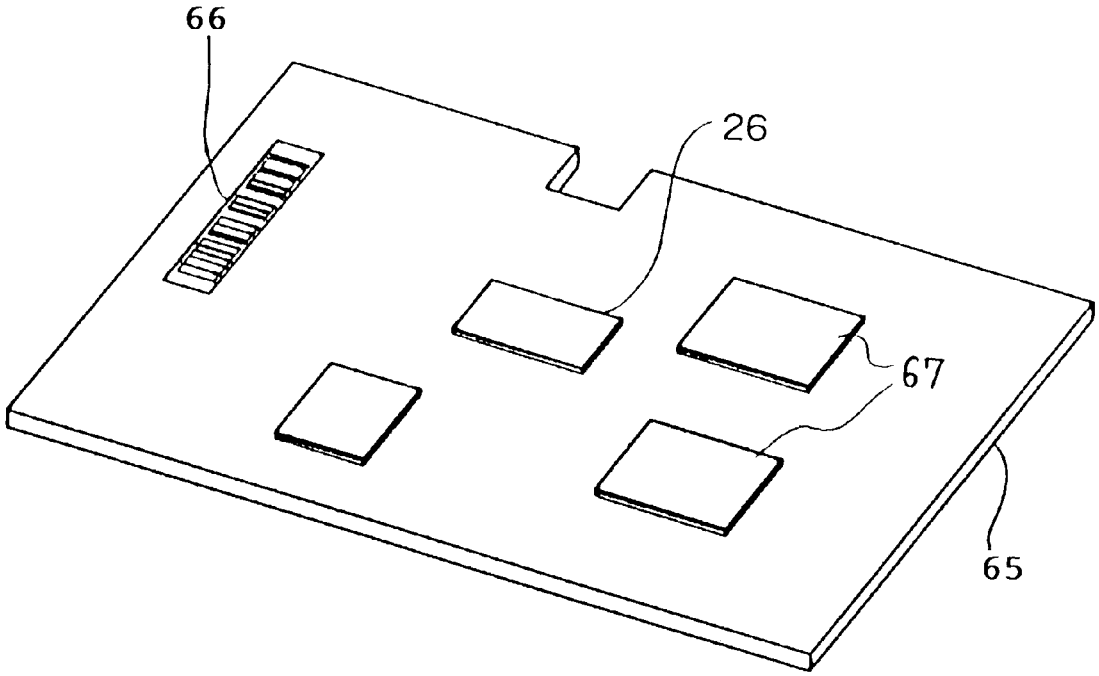
FIG. 4 is a perspective view of a board equipped in the embroidery sewing machine.

The EEPROM 26 is mounted on a board 65 together with another LSI (Large Scale Integrated Circuit) 67 containing a CPU for controlling the whole operation of the embroidery sewing machine M and the like, as shown in FIG. 4. A bar code label 66, in which at least the production serial number 31 among the information included in the identification information 30 is made into a bar code and printed, is put on another position of the board 65.

As for the production serial number 31, a value which is not continuous value but is discontinuous (intermittent) value may be given to each embroidery sewing machine M when the embroidery sewing machines M are produced, in order to prevent parts from being stolen.

Next, a configuration and a schematic operation of the pattern data editing apparatus will be explained below with reference to FIG. 5 to FIG. 8D.

At first, the configuration of the pattern data editing apparatus is explained with reference to FIG. 5.

Figure 5:
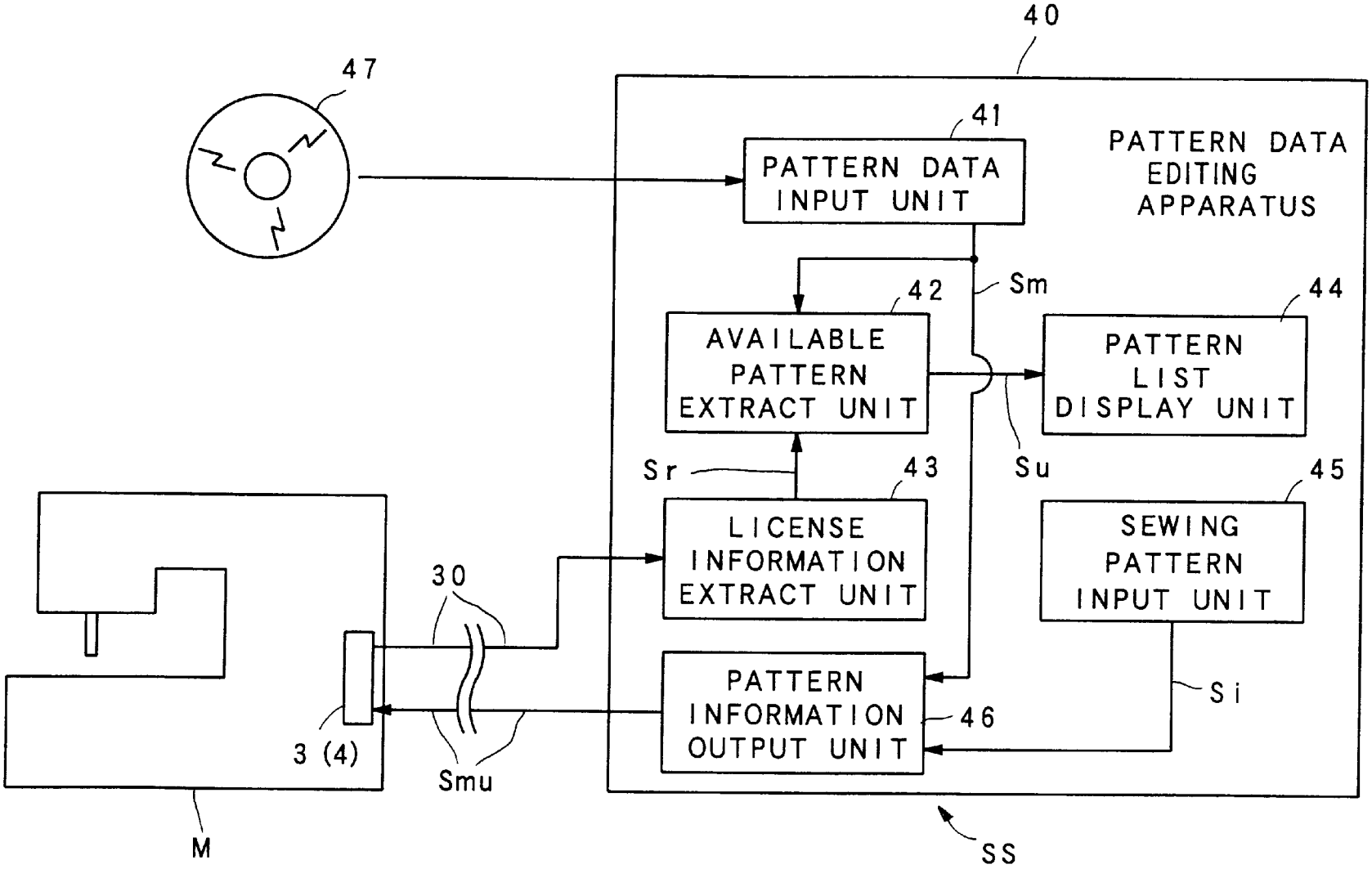
FIG. 5 is a block diagram showing a schematic configuration of a sewing apparatus including the embroidery sewing machine.

As shown in FIG. 5, a pattern data editing apparatus 40 of the first embodiment is provided with: a pattern data input unit 41 composed of a CD-ROM (Compact Disk-Read Only Memory) driver and the like; an available pattern extract unit 42; a pattern list display unit 44 composed of a CRT (Cathode Ray Tube) display or an LCD; a license information extract unit 43; a sewing pattern input unit 45 composed of a keyboard and the like; and a pattern information output unit 46 servicing as one example of a data outputting device. Among them, the license information extract unit 43 and the pattern information output unit 46 are connected to the card connector 3 or the communication connector 4 by using various methods, which will be described later.

A sewing apparatus SS as the first embodiment is constituted by the pattern data editing apparatus 40 having the above mentioned configuration and the aforementioned embroidery sewing machine M. Incidentally, the embroidery sewing machine M and the pattern data editing apparatus 40 are installed in a house of a user who uses the embroidery sewing machine M and the like.

Next, an operation of the sewing apparatus SS is explained mainly as for the operation of the pattern data editing apparatus 40.

When the embroidery sewing machine M is connected to the pattern data editing apparatus 40, the identification information 30 is outputted from the embroidery sewing machine M to the license information extract unit 43.

Then, the license information extract unit 43 extracts license information Sr indicative of the pattern data corresponding to a pattern which can be embroidered by the embroidery sewing machine M (in the embroidery sewing machine M, patterns that can be embroidered are determined in advance by a distributor, a maker or the like on the basis of a rank of the embroidery sewing machine M) from among the various information included in the identification information 30, and outputs it to the available pattern extract unit 42.

On the other hand, the pattern data input unit 41 reads out the recorded pattern data from a CD-ROM 47 servicing as one example of a pattern data storing device, on which the pattern data corresponding to various embroidery patterns is recorded in advance, and outputs it as pattern information Sm to the available pattern extract unit 42 and the pattern information output unit 46.

Then, the available pattern extract unit 42 outputs, from among the pattern data included in the inputted pattern information Sm, the pattern data which is allowed to be used on the basis of the license information Sr, as available pattern information Su, to the pattern list display unit 44. Then, the pattern list display unit 44 displays the patterns corresponding to the pattern data included in the outputted available pattern information Su as available patterns.

Next, when a user sees the displayed patterns and selects a pattern to be embroidered, an input process corresponding to the selection is performed by the sewing pattern input unit 45. Then, corresponding input information Si is outputted to the pattern information output unit 46.

Then, the pattern information output unit 46 outputs, from among the pattern data included in the inputted pattern information Sm, the pattern data corresponding to the input information Si as available pattern information Smu to the embroidery sewing machine M.

After that, the embroidery sewing machine M executes the embroidering process in accordance with the pattern data included in the inputted available pattern information Smu. At this time, when a plurality of kinds of patterns are selected by the user through the sewing pattern input unit 45, a pattern to be actually embroidered is further selected from among these selected patterns for the embroidery sewing machine M and is then embroidered.

Moreover, the pattern data editing apparatus 40 is adapted to combine a plurality of patterns recorded on the CD-ROM 47 to then edit a new pattern.

Next, a configuration of the pattern data recorded on the CD-ROM 47 is explained below with reference to FIG. 6.

Figure 6:
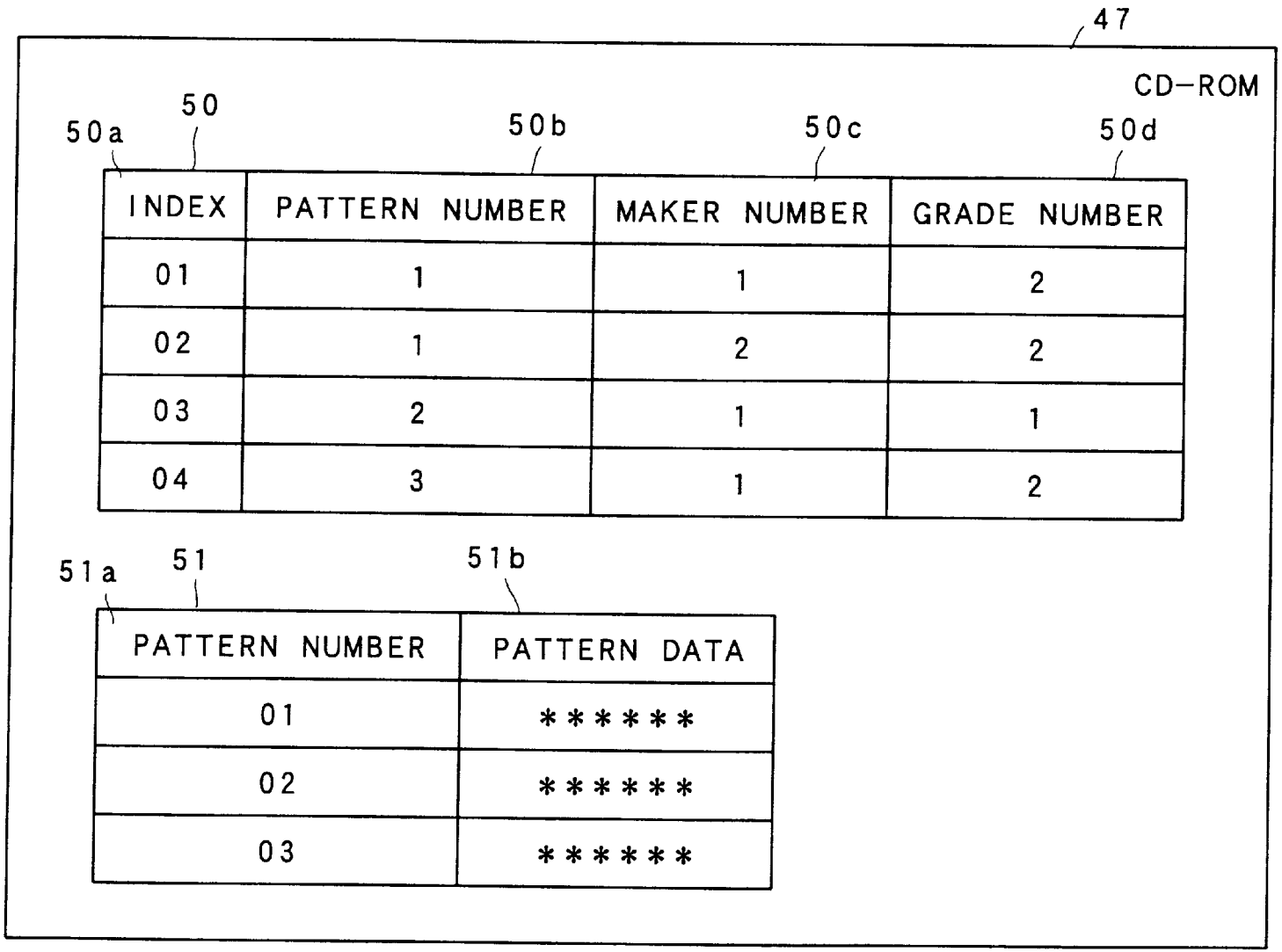
FIG. 6 is a diagram showing a data structure of pattern data.

As shown in FIG. 6, index data 50 and main data 51 as the substance of the pattern data are recorded in the pattern data on the CD-ROM 47, as roughly classified.

Among them, the index data 50 includes an index 50*a* indicative of a serial number, a pattern number 50*b*, a maker number 50*c* and a grade number 50*d* similar to those of the identification information 30 (refer to FIG. 3). The maker number 50*c* and the grade number 50*d* are recorded as a pair for each pattern number 50*b*.

The main data 51 includes pattern number 51*a* and pattern data 51*b* for an actual embroidery.

Accordingly, when the pattern data is read out from the CD-ROM 47 by the use of the pattern data input unit 41, the pattern data editing apparatus 40 simultaneously reads out the index data 50 and then outputs it to the available pattern extract unit 42 as the pattern information Sm.

On the basis of the license information Sr (more actually, the maker number 32 and the grade number 33 within the identification information 30) based on the identification information 30 outputted from the embroidery sewing machine M, the available pattern extract unit 42 compares the index data 50 inputted as the pattern information Sm with the license information Sr, and then outputs patterns having the maker number 50*c* and the grade number 50*d*, which coincide with the license information Sr, as the available pattern information Su, to the pattern list display unit 44.

Then, the pattern data 51*b* corresponding to the pattern number 51*a* of the pattern specified by the pattern data input unit 45 is outputted together with the pattern number 51*a* to the embroidery sewing machine M as the available pattern information Smu.

Next, the actual process in the pattern data editing apparatus 40 when the pattern data is sent to the embroidery sewing machine M (hereafter, referred to as a download or a downloading process) is explained below with reference to a flowchart shown in FIG. 7.

Figure 7:
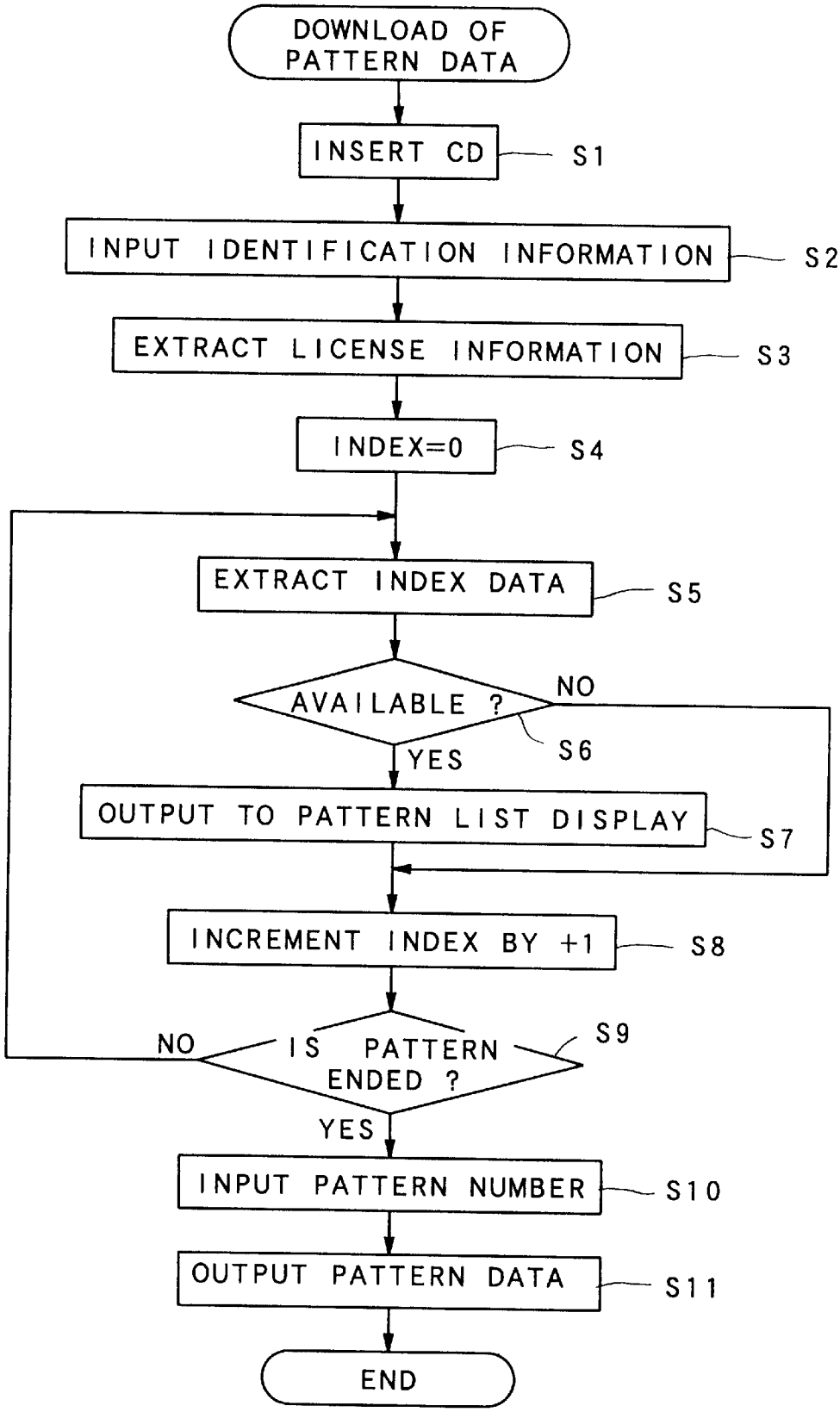
FIG. 7 is a flowchart showing an operation of downloading the pattern data.

In FIG. 7, when the pattern data is downloaded from the pattern data editing apparatus 40 to the embroidery sewing machine M, the CD-ROM 47 is firstly inserted into the pattern data editing apparatus 40 (Step S1). Then, the identification information 30 is outputted from the embroidery sewing machine M and is inputted to the pattern data editing apparatus 40 (Step S2).

Then, the license information Sr is extracted from the identification information 30 (Step S3). Then, a parameter INDEX indicative of the index 50*a* is initialized (Step S4).

Then, the index data 50 is read out from the pattern data read out through the pattern data input unit 41 from the CD-ROM 47 (Step S5). The index data 50 read out by the available pattern extract unit 42 is compared with the license information Sr. Accordingly, it is judged whether or not a pattern corresponding to the parameter INDEX indicative of the index 50*a* "0" is available in the embroidery sewing machine M by which the identification information 30 is outputted (Step S6). If it is available (Step S6; YES), the pattern corresponding to the parameter INDEX indicative of the index 50*a* "0" is outputted to the pattern list display unit 44 (Step S7). Then, the parameter INDEX indicative of the index 50*a* is incremented by "1" (Step S8). Then, it is judged whether or not the comparison with the license information Sr is ended for all the patterns (Step S9). If the comparison is not ended (Step S9; NO), the operational flow again returns to the step S5.

If the comparison with the license information Sr is ended for all the patterns (Step S9; YES), a pattern to be downloaded to the embroidery sewing machine M is selected by the user and inputted by the sewing pattern input unit 45 (Step S10). Then, the pattern data 51*b* corresponding to the selected pattern is outputted to the embroidery sewing machine (Step S11). Then, a series of processes are ended.

On the other hand, if it is judged by the judgment at the step S6 that the pattern in which the parameter INDEX indicative of the index 50*a "0"* is not available in the embroidery sewing machine M by which the identification information 30 is outputted (Step S6; NO), the operational flow directly proceeds to the step S8 without displaying the pattern on the pattern list display unit 44.

Next, a method of connecting the embroidery sewing machine M and the pattern data editing apparatus 40 to each other is actually explained with reference to FIG. 8A to FIG. 8D.

Figure 8A:
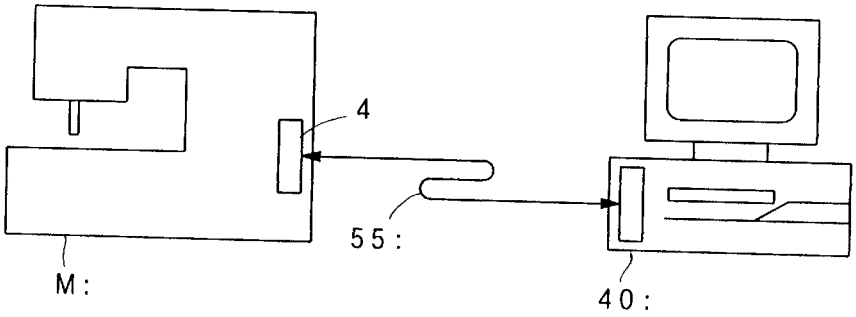
FIG. 8A is a diagram showing one example of a connection between the embroidery sewing machine and a pat tern data editing apparatus by means of a serial cable.
Figure 8B:
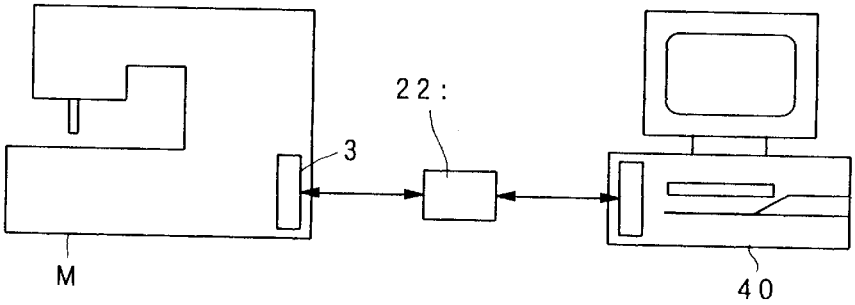
FIG. 8B is a diagram showing one example of a connection between the embroidery sewing machine and a pattern data editing apparatus by means of an external ROM card.
Figure 8C:
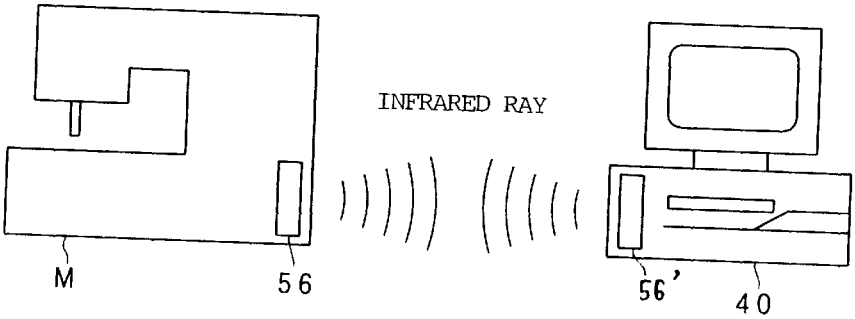
FIG. 8C is a diagram showing one example of a connection between the embroidery sewing machine and a pattern data editing apparatus by means of an infrared ray.
Figure 8D:
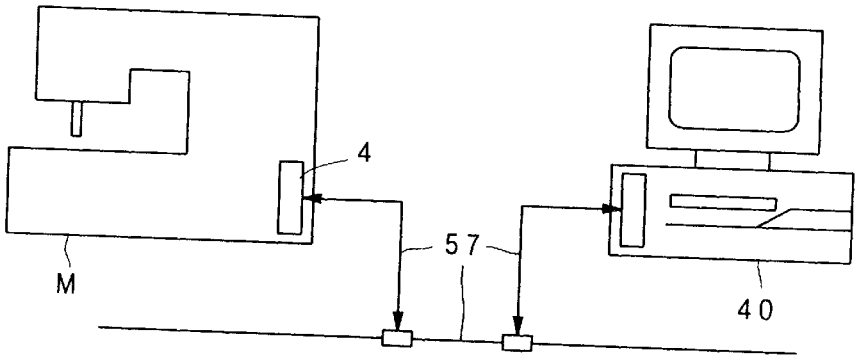
FIG. 8D is a diagram showing one example of a connection between the embroidery sewing machine and a pattern data editing apparatus by means of an Ethernet cable.

There are various methods as a method of sending and receiving the data between the embroidery sewing machine M and the pattern data editing apparatus 40. As an actual example, for example, as shown in FIG. 8A, it is possible to connect the external connection connector 4 of the embroidery sewing machine M and the pattern data editing apparatus 40 to each other directly through a serial cable 55 to thereby send and receive the data. Alternatively, as shown in FIG. SB, it is possible to send and receive the data between the card connector 3 of the embroidery sewing machine M and the pattern data editing apparatus 40 through a rewritable external ROM card 22. Alternatively, as shown in FIG. 8C, it is possible to dispose an infrared ray emitting and receiving unit 56 in the embroidery sewing machine M to then use the infrared ray to thereby send and receive the data to and from an infrared ray emitting and receiving unit 56' built in the pattern data editing apparatus 40. Alternatively, as shown in FIG. 8D, it is possible to connect the external connection connector 4 of the embroidery sewing machine M and the pattern data editing apparatus 40 to each other through a so-called Ethernet cable 57 to thereby send and receive the data. In the present embodiment, not only the LAN (Local Area Network) using the Ethernet cable but also any type of the LAN may be employed. For example, the token ring type LAN, the LAN using the optical fiber cable and so on, may be employed in the present embodiment.

Incidentally, the processes shown in FIG. 7 are executed in accordance with the program stored in the CD-ROM 47 as one example of a program storage medium which is installed into the RAM 18 of the pattern data editing apparatus 40 in advance. The program may be stored in the ROM servicing as another example of the program storage medium (not shown) and the like built in the pattern data editing apparatus 40.

As explained above, according to the operations of the sewing apparatus SS as the first embodiment, only the pattern data 51*b* specified by the license information Sr within the identification information 30 is sent to the embroidery sewing machine M. Thus, it is possible to prevent the pattern data 51*b*, which should not be used in the embroidery sewing machine M, from being sent thereto.

Not only the identification information 30 includes the maker information 32, but also the index data 50 includes the maker information 50*c*. Hence, even if the CD-ROM 47 is shared between the embroidery sewing machines produced by a plurality of makers, it is possible to download only the pattern data which can be used by the respective embroidery sewing machine M.

(II) Second Embodiment

A second embodiment of the present invention will be explained below with reference to FIG. 9A to FIG. 10. Incidentally, in a flowchart shown in FIG. 10, the same processes as those in the flowchart shown in FIG. 7 carry the same step numbers, and the detailed explanations thereof are omitted.

In the first embodiment, the information peculiar to the embroidery sewing machine M is used as the identification information 30. In the second embodiment, in addition to this, personal identification information peculiar to each user who uses the embroidery sewing machine M (e.g., an identification number given to the user or purchaser when the embroidery sewing machine M is purchased) is used to manage the supply of the pattern data.

A configuration of a sewing apparatus of the second embodiment is basically similar to that of the pattern data editing apparatus 40 and the embroidery sewing machine M in the first embodiment. In addition to them, the second embodiment has a configuration that, for example, the pattern data editing apparatus can be connected to a personal identification information database, in which the personal identification information managed by a maker of the embroidery sewing machine M is accumulated, through a network such as a telephone line and the like.

Figure 9A:
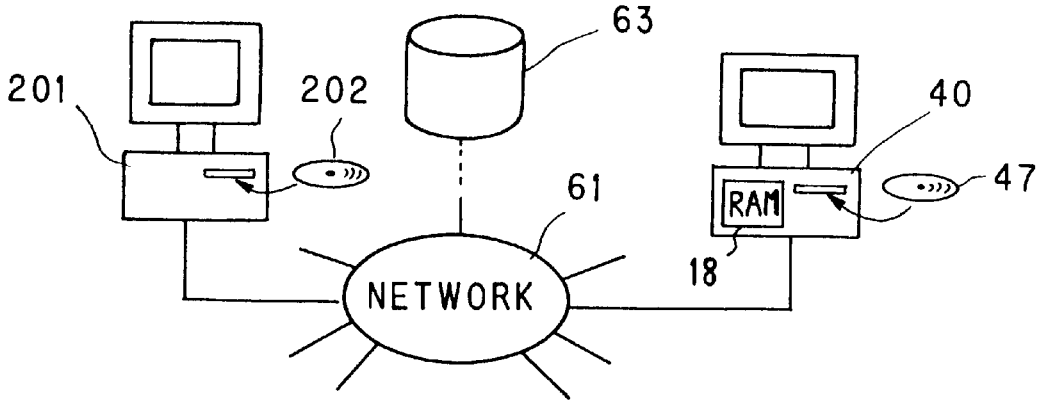
FIG. 9A is a block diagram of a sewing apparatus in a second embodiment of the present invention.

Namely, as shown in FIG. 9A, a pattern data editing apparatus 40 is connected to a personal identification information database 63, which is managed by the maker, through a network 61. A terminal device 201 servicing as one example of a personal identification information input unit, through which the personal identification information is inputted by the distributor, is also connected to the personal identification information database 63 through the network 61. The pattern data editing apparatus 40 performs the following process in addition to the aforementioned data editing process same as the first embodiment in accordance with a program stored in the CD-ROM 47, while the terminal device 201 performs the following data base registration process in accordance with a program stored in a CD-ROM 202, for example.

Figure 9B:
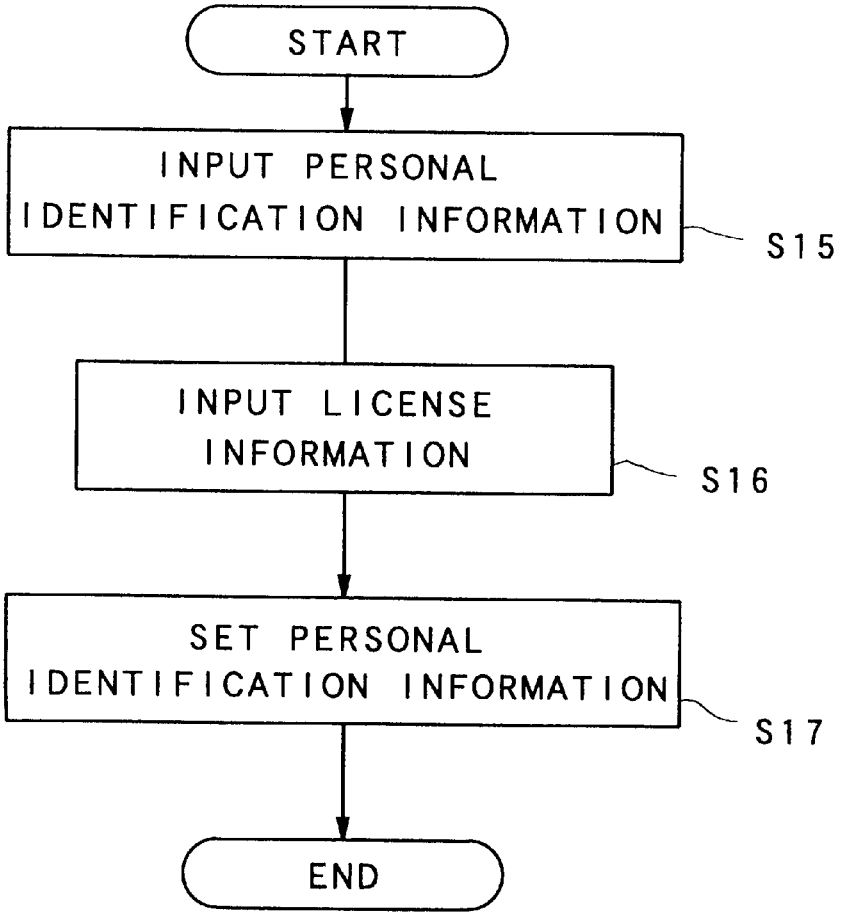
FIG. 9B is a flowchart showing an operation of setting personal identification information in the second embodiment.

In the second embodiment, as shown in FIG. 9B, before the download of the pattern data, the personal identification information given by the distributor when the embroidery sewing machine M is purchased is inputted from the terminal device 201 (Step S15). Then, the aforementioned license information Sr (e.g., the maker number 32 and the grade number 33) corresponding to the purchased embroidery sewing machine M is inputted from the terminal device 201 (Step S16). Then, a process of registering both of the personal identification information and the license information Sr onto the personal identification information database 63 is carried out through the network 61 (Step S17).

Figure 10:
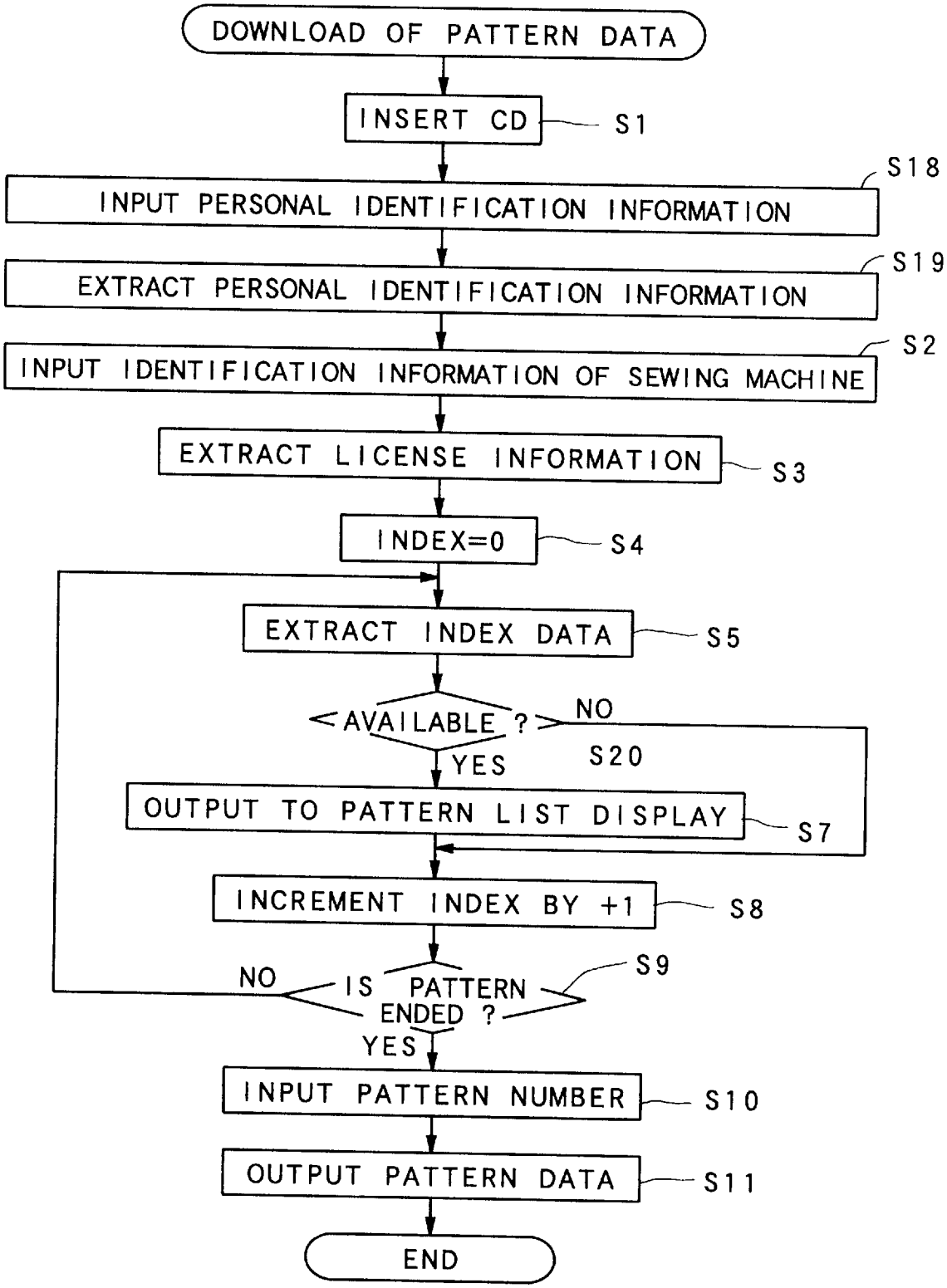
FIG. 10 is a flowchart showing an operation of downloading pattern data in which the personal identification information is used in the second embodiment.

As shown in FIG. 10, in the actual download of the pattern data, after the operation at the step S1 is firstly executed, the personal identification information is inputted to the pattern data editing apparatus 40 (Step S18).

Then, the registered personal identification information and license information Sr are extracted (Step S19) after the query to the personal identification information database 63 through the network 61 on the basis of the inputted personal identification information.

After that, the operations at the steps S2 to S5 are executed. Then, it is judged at a step S20 whether or not the license information Sr extracted in conjunction with the inputted personal identification information is extracted at the step S3, and it is also judged whether or not the pattern corresponding to the parameter INDEX indicative of the index 50*a* "0" is available in the embroidery sewing machine M by which the identification information 30 is outputted (Step S20). Only if the extracted license information Sr coincides with the license information Sr extracted at the step S3 and further the pattern corresponding to the parameter INDEX indicative of the index 50*a* "0" is available in the embroidery sewing machine M by which the identification information 30 is outputted (Step S20; YES), the pattern corresponding to the parameter INDEX indicative of the index 50*a* "0" is outputted to the pattern list display unit 44 (Step S7). After that, the operations at the steps S8 to S11 are executed.

On the other hand, if it is judged by the judgment at the step S20 that the extracted license information Sr does not coincide with the license information Sr extracted at the step S3 or that the pattern corresponding to the parameter INDEX indicative of the index 50*a* "0" is not available in the embroidery sewing machine M by which the identification information 30 is outputted (Step S20; NO), the pattern is not outputted to the pattern list display unit 44, and the operational flow directly proceeds to the step S8.

Incidentally, the processes shown in FIG. 10 are executed in accordance with the program stored in the CD-ROM 47 as one example of a program storage medium which is installed into the RAM 18 of the pattern data editing apparatus 40 in advance. The program may be stored in the ROM servicing as another example of the program storage medium (not shown) and the like built in the pattern data editing apparatus 40.

As explained above, according to the operations of the sewing apparatus of the second embodiment, since only the pattern data corresponding to the inputted personal identification information and the license information Sr for each embroidery sewing machine M is outputted to the embroidery sewing machine M, in addition to the effect of the sewing apparatus SS in the first embodiment, it is possible to prevent a user who should not use the pattern data 51*b* from using the pattern data 51*b*.

(III) Third Embodiment

A third embodiment in the present invention will be explained below with reference to FIG. 11 to FIG. 13.

The first and second embodiments are mainly related to the download of the pattern data 51*b* in a house of a user who has purchased the embroidery sewing machine M. The third embodiment is an embodiment in which the identification information 30 is used when sending and receiving the information with regard to the repair of the embroidery sewing machine M between the distributor, to which the user who has purchased the embroidery sewing machine M brings the embroidery sewing machine M, and the maker, who has produced the embroidery sewing machine M.

Figure 11:
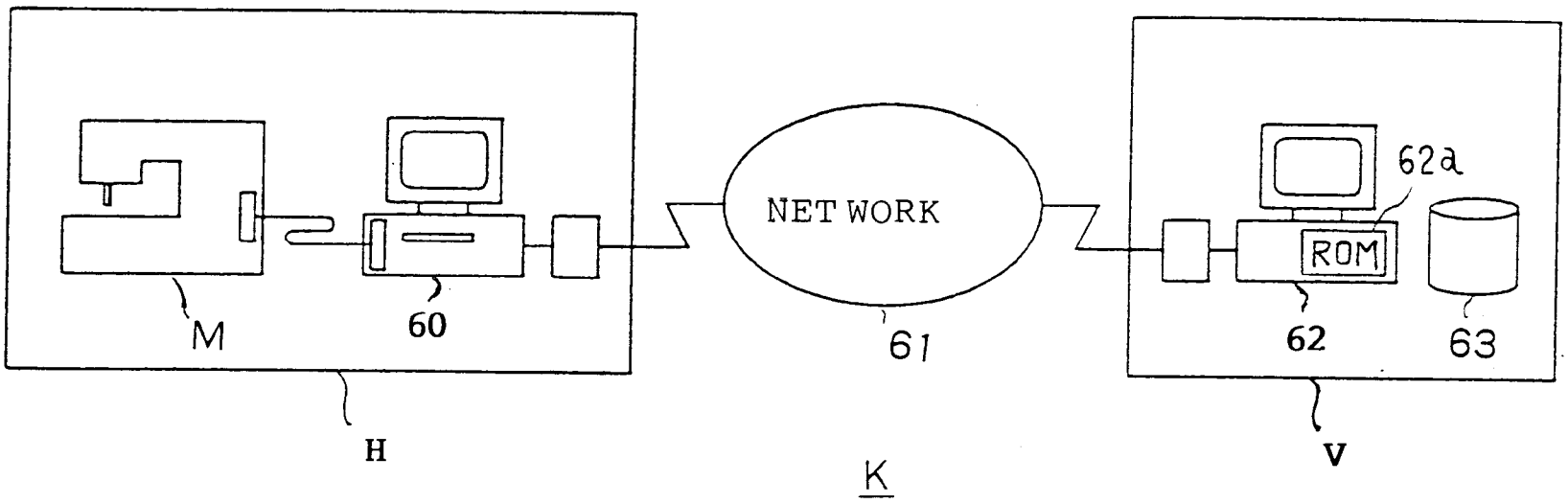
FIG. 11 is a block diagram showing a schematic configuration of a management system in a third embodiment of the present invention.

At first, the whole configuration of the management system including the distributor and the maker in the third embodiment is explained FIG. 11.

As shown in FIG. 11, in a management systemK of the third embodiment, a client computer 60 to be connected to the purchased embroidery sewing machine M to thereby fetch the identification information 30 is disposed at a distributor H into which the embroidery sewing machine M needing the repair is brought. This client computer 60 is connected through a network 61, such as a telephone line and the like, to a host computer 62 disposed in a maker V to thereby enable the data to be sent to and received from the host computer 62.

On the other hand, the host computer 62 servicing as one example of an updating device and a managing apparatus disposed in the maker V manages the database 63 servicing as one example of a repair history storage device and a memory device for storing a previous repair history with regard to all the embroidery sewing machines M produced by the maker V. This repair history includes, for example, a repair date, a repair content, a replaced part list and the like. The above mentioned information is recorded in the database 63 under a condition that the information can be fetched and it is correlated with the identification information 30, for each embroidery sewing machine M.

Next, a flow of a process of repairing the embroidery sewing machine M brought into the distributor H by using the configuration shown in FIG. 11 is explained with reference to FIG. 12A.

Figure 12A:
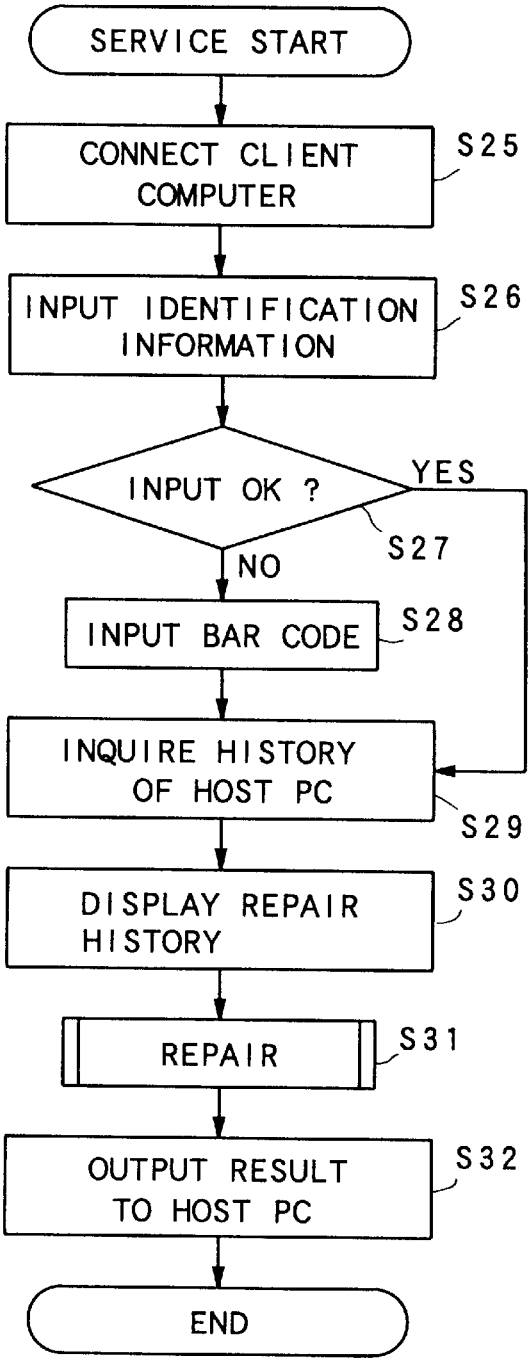
FIG. 12A is a main flowchart showing an operation associated with a repair in the third embodiment.
Figure 13:
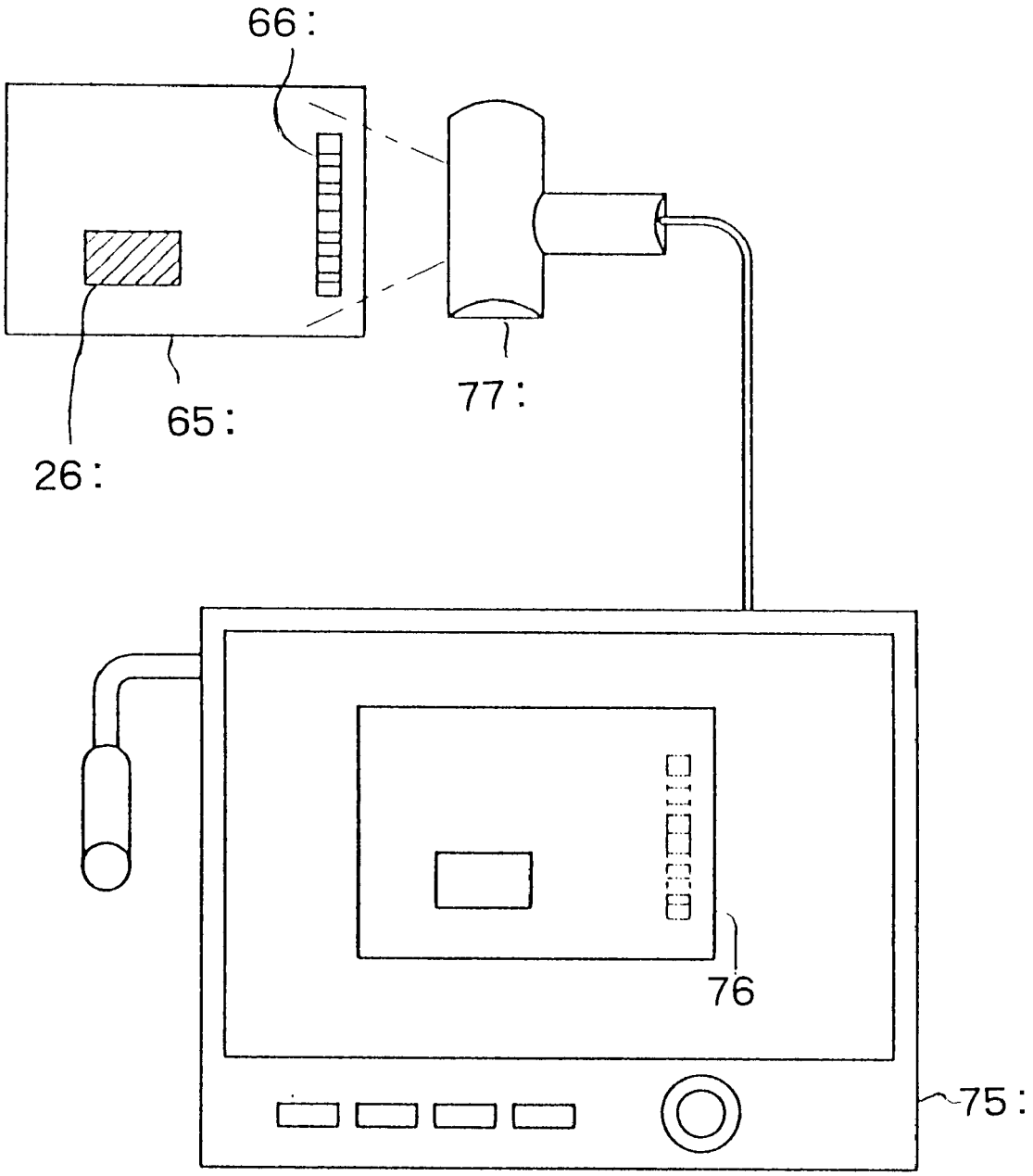
FIG. 13 is a plan view showing a schematic configuration of a board checker with a scanner and the board in the third embodiment.

In FIG. 12A, when the embroidery sewing machine M is brought into the distributor H, the embroidery sewing machine M is firstly connected to the client computer 60 (Step S25). Then, the identification information 30 is inputted from the embroidery sewing machine M to the client computer 60 (Step S26).

Then, it is judged whether or not the identification information 30 is normally inputted from the EEPROM 26 within the embroidery sewing machine M (Step S27). If the identification information 30 is not normally inputted, for example, because of the abnormal operation of the EEPROM 26 and the like (Step S27; NO), the identification information 30 is inputted to the client computer 60 by reading the content of the bar code label 66 put on the board 65 as shown in FIG. 4 (Step S28). Then, the inputted identification information 30 is sent to the host computer 62, and the repair history corresponding to the identification information 30 is inquired of the host computer 62 (Step S29). At this time, the host computer 62 uses the identification information 30 sent from the client computer 60 to then fetch the repair history corresponding to the production serial number 31 within the identification information 30 from the database 63 to thereby send it to the client computer 60 as the reply.

On the other hand, if it is judged by the judgment at the step S27 that the identification information 30 is normally inputted (Step S27; YES), the operational flow directly proceeds to the step S29. Then, the inputted identification information 30 is used to carry out the query about the repair history.

The repair history obtained from the host computer 62 by the query is displayed on the client computer 60 (Step S30). The actual repair is executed by referring to the repair history (Step S31).

After the repair, the content of the repair and the like are sent to the host computer 62 together with the identification information 30 as a new repair history. Then, the process is ended.

Incidentally, the host computer 62 receiving the new repair history updates the corresponding repair history within the database 63 on the basis of the identification information 30.

Figure 12B:
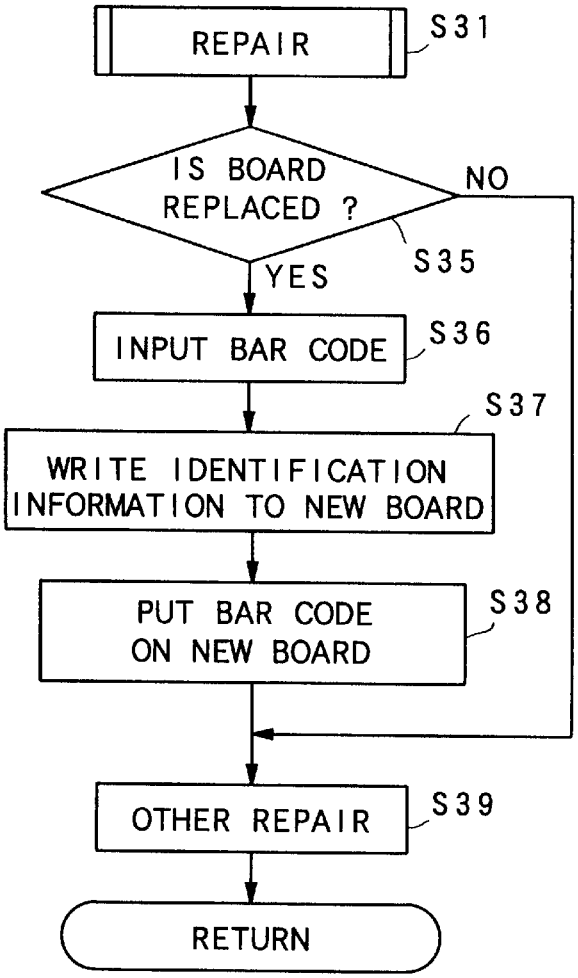
FIG. 12B is a flowchart showing a content of a repairing process in the third embodiment.

Next, the content of the repair at the step S31 is explained with reference to FIG. 12B.

At first, the board 65 of the brought embroidery sewing machine M is taken out before the repair. It is judged whether or not the board 65 normally operates (Step S35).

If it is judged that the replacement of the board is required because the board 65 itself does not normally operate (Step S35; YES), the content of the bar code label 66 (the identification information 30) is read in by using a scanner 77 associated with a board checker 75 for inspecting a function of the board 65 as shown in FIG. 13 (Step S36). The identification information 30 is written to a new board 76 through the board checker 75 (Step S37). Moreover, the bar code label 66 on the faulty board 65 is put on the new board 76 (Step S38).

Then, another repair other than that of the board is executed (Step S39). The operational flow proceeds to the step S32 in FIG. 12A.

On the other hand, if it is judged by the judgment at the step S35 that the replacement of the board 65 is not required (Step S65; NO), the operational flow directly proceeds to the step S39 as it is.

After the above mentioned processes, the new board 76 having the identification information 30 peculiar to the embroidery sewing machine M functions as a new board.

Incidentally, the processes at the host computer 62 among the above mentioned processes are executed in accordance with the program stored in a ROM 62*a* or the like servicing as one example of a record medium built in the host computer 62.

As explained above, according to the processes of the management system K in the third embodiment, the repair history information on the database 63 is updated and managed in accordance with the identification information 30. Thus, when the embroidery sewing machine M is to be repaired, it is possible to refer to the previous repair history to thereby carry out the effective repairing operation.

Figure 14:
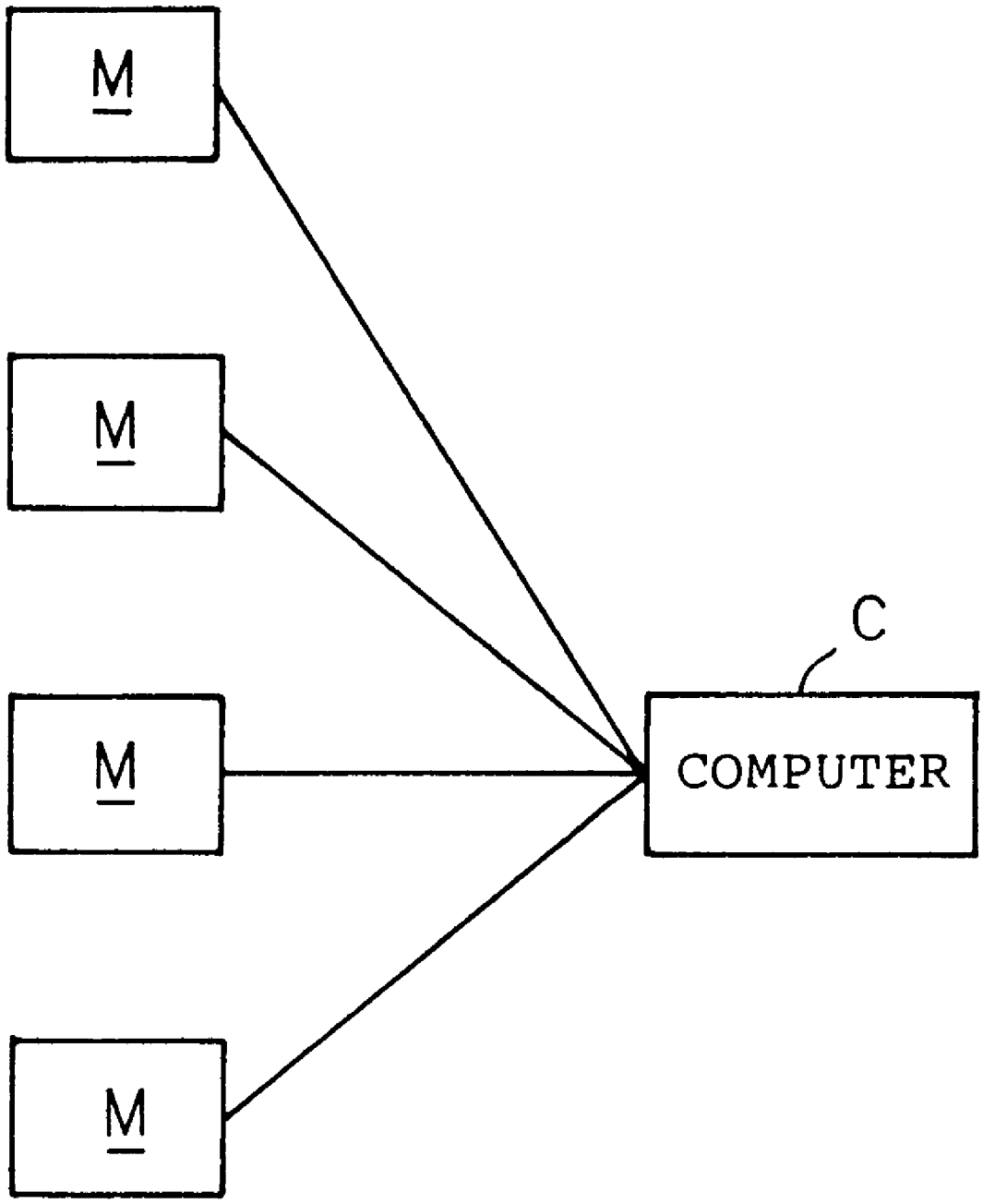
FIG. 14 is a block diagram showing a configuration of a sewing apparatus including a plurality of embroidery sewing machines as a modified embodiment of the present invention.

In the above described embodiments, the single embroidery sewing machine M is controlled by the pattern data editing apparatus 40. In addition, the present invention can be applied to a sewing apparatus in which a plurality of embroidery sewing machines M are collectively controlled by a computer C function as the pattern data editing apparatus 40, as shown in FIG. 14. In FIG. 14, each sewing machine M is collectively controlled through a communication line by the computer C such as a personal computer. In this case, the management as for the selection of the sewing patterns, the inquiry of the repair information or the like can be collectively controlled by the single computer C.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

The entire disclosure of Japanese Patent Application No. 09-267423 filed on Sep. 30, 1997 including the specification, claims, drawings and summary is incorporated herein by reference in its entirety.

What is claimed is:

1. A sewing apparatus comprising (a) a sewing machine comprising:

an identification information storing device in said sewing machine for storing machine identification information, which is individually set in advance for said sewing machine;

an identification information outputting device for outputting the machine identification information stored in said identification information storing device; and a sewing device for sewing a pattern, and (b) a management apparatus separate and connectable to said sewing machine, for managing said sewing machine based on the machine identification information received from said identification information outputting device when said sewing machine is connected to said management apparatus.

2. A sewing apparatus according to claim 1, wherein said management apparatus comprises:

a repair history storing device for storing repair history information indicating a repair history recorded for said sewing machine when said sewing machine is repaired; and an updating device for updating the repair history information corresponding to said sewing machine which has been repaired based on the machine identification information corresponding to said sewing machine which has been repaired, in said repair history storing device.

3. A sewing apparatus according to claim 1, wherein said management apparatus comprises:

a pattern data storing device for storing various kinds of pattern data indicating various kinds of patterns set in advance for a sewing process performed by said sewing machine; and a data outputting device for outputting only pattern data corresponding to the machine identification information received from said identification information outputting device when said sewing machine is connected to said management apparatus, from among the various kinds of pattern data stored in said pattern data storing device, as pattern data particular to said sewing machine, and wherein said sewing device performs the sewing process based on the particular pattern data outputted by said data outputting device.

4. A sewing apparatus according to claim 3, wherein the machine identification information includes specification information to specify the particular pattern data indicating a pattern sewable by said sewing machine, and said data outputting device outputs only pattern data specified by the specification information, which is included in the machine identification information received from said identification information outputting device, from among the various kinds of pattern data stored in said pattern data storing device, as the particular pattern data indicating a pattern sewable by said sewing machine.

5. A sewing apparatus according to claim 4, wherein the specification information includes information indicating at least one of a maker and a grade of said sewing machine.

6. A sewing apparatus according to claim 5, wherein said pattern data storing device stores the various kinds of pattern data in correlation with information indicating at least one of a maker and a grade of said sewing machine, and said data outputting device outputs the pattern data by matching the information indicating at least one of the maker and the grade included in the specification information and that stored in said pattern data storing device.

7. A sewing apparatus according to claim 3, wherein said management apparatus further comprises a personal information inputting device for inputting personal identification information to identify a user who uses said sewing machine to perform the sewing process based on the particular pattern data, and said data outputting device outputs only pattern data corresponding to the inputted personal identification information and the received machine identification information, as the pattern data particular to said sewing machine.

8. A sewing apparatus according to claim 1, wherein said sewing machine and said management apparatus are connected to each other by a serial cable.

9. A sewing apparatus according to claim 1, wherein said sewing machine and said management apparatus are connected to each other by an external rewritable ROM card.

10. A sewing apparatus according to claim 1, wherein said sewing machine and said management apparatus are connected to each other by an infrared ray.

11. A sewing apparatus according to claim 1, wherein said sewing machine and said management apparatus are connected to each other by a local area network cable.

12. A program storage medium readable by a computer in a sewing apparatus comprising a sewing machine and a management apparatus which is separate and connectable to said sewing machine, tangibly embodying a program of instructions executable by said computer to perform method processes for managing said sewing machine by said management apparatus, said method processes comprising:

an identification information storing process of storing machine identification information, which is individually set in advance for said sewing machine, into an identification information storing device in said sewing machine;

an identification information outputting process of outputting the machine identification information stored in said identification information storing device from an identification information outputting device in said sewing machine;

a sewing process of sewing a pattern in said sewing machine; and a managing process of managing said sewing machine based on the machine identification information received from said identification information outputting device when said sewing machine is connected to said management apparatus.

13. A program storage medium according to claim 12, wherein said managing process comprises:

a repair history storing process of storing repair history information indicating a repair history recorded for said sewing machine into a repair history storing device in said management apparatus when said sewing machine is repaired; and an updating process of updating the repair history information corresponding to said sewing machine which has been repaired based on the machine identification information corresponding to said sewing machine which has been repaired, in said repair history storing device.

14. A program storage medium according to claim 12, wherein said managing process comprises:

a pattern data storing process of storing various kinds of pattern data indicating various kinds of patterns set in advance for the sewing process performed by said sewing machine, into a pattern data storing device in said management apparatus; and a data outputting process of outputting only pattern data corresponding to the machine identification information received from said identification information outputting device when said sewing machine is connected to said management apparatus, from among the various kinds of pattern data stored in said pattern data storing device, as pattern data particular to said sewing machine, and wherein in said sewing process, the pattern is sewn by said sewing machine based on the particular pattern data outputted by said data outputting process.

15. A program storage medium according to claim 14, wherein the machine identification information includes specification information to specify the particular pattern data indicating a pattern sewable by said sewing machine, and in said data outputting process, only pattern data specified by the specification information, which is included in the machine identification information received from said identification information outputting device, is outputted from among the various kinds of pattern data stored in said pattern data storing device, as the particular pattern data indicating a pattern sewable by said sewing machine.

16. A program storage medium according to claim 15, wherein the specification information includes information indicating at least one of a maker and a grade of said sewing machine.

17. A program storage medium according to claim 16, wherein in said pattern data storing process, the various kinds of pattern data are stored in correlation with information indicating at least one of a maker and a grade of said sewing machine, and in said data outputting process, the pattern data is outputted by matching the information indicating at least one of the maker and the grade included in the specification information and that stored in said pattern data storing process.

18. A program storage medium according to claim 14, wherein said method processes further comprise a personal information inputting process of inputting personal identification information to identify a user who uses said sewing machine to perform the sewing process based on the particular pattern data, and in said data outputting process, only pattern data corresponding to the inputted personal identification information and the received machine identification information is outputted as the pattern data particular to said sewing machine.

19. A sewing apparatus comprising (a) a sewing machine comprising:

an identification information storing means in said sewing machine for storing machine identification information, which is individually set in advance for said sewing machine;

an identification information outputting means for outputting the machine identification information stored in said identification information storing means; and a sewing means for sewing a pattern, and (b) a management apparatus separate and connectable to said sewing machine, comprising means for managing said sewing machine based on the machine identification information received from said identification information outputting means when said sewing machine is connected to said management apparatus.

20. A sewing apparatus according to claim 19, wherein said management apparatus comprises:

external data storing means for storing various kinds of pattern data indicating various kinds of patterns set in advance for a sewing process performed by said sewing means: and a data outputting means for outputting only pattern data corresponding to the machine identification information received from said identification information outputting means when said sewing means is connected to said management apparatus, from among the various kinds of pattern data stored in said external data storing means, as pattern data particular to said sewing machine, and wherein said sewing means performs the sewing process based on the particular pattern data outputted by said data outputting means.

21. The sewing apparatus according to claim 1, wherein the machine identification information is electronically written in the identification information storing device.

22. The sewing apparatus according to claim 1, further comprising a plurality of sewing machines, wherein each sewing machine is managed based on the identification information stored in a respective one of the plurality of sewing machines.

23. The sewing apparatus according to claim 3, wherein said pattern data storing device comprises an external storage device.

24. The sewing apparatus according to claim 23, wherein the machine identification information is electrically written in the identification information storing device.

* * * * *